US008654066B2

(12) United States Patent
Jung et al.

(10) Patent No.: US 8,654,066 B2
(45) Date of Patent: Feb. 18, 2014

(54) DISPLAY APPARATUS AND METHOD FOR CONTROLLING BACKLIGHT THAT CAN REDUCE IMAGE DISTORTION DUE TO LOCAL DIMMING

(75) Inventors: Hye Dong Jung, Seoul (KR); Hyung Su Lee, Seoul (KR)

(73) Assignee: Korea Electronics Technology Institute, Seongnam-si (KR)

( * ) Notice: Subject to any disclaimer, the term of this patent is extended or adjusted under 35 U.S.C. 154(b) by 539 days.

(21) Appl. No.: 12/977,591

(22) Filed: Dec. 23, 2010

(65) Prior Publication Data

US 2012/0044222 A1 Feb. 23, 2012

(30) Foreign Application Priority Data

Aug. 20, 2010 (KR) ..... 10-2010-0081028

(51) Int. Cl.
*G09G 3/36* (2006.01)

(52) U.S. Cl.
USPC ..... 345/102

(58) Field of Classification Search
USPC ..... 345/207, 102
See application file for complete search history.

(56) References Cited

U.S. PATENT DOCUMENTS

| | | | | |
|---|---|---|---|---|
| 6,762,741 | B2 | 7/2004 | Weindorf | |
| 8,462,101 | B2 * | 6/2013 | Han et al. | 345/102 |
| 2006/0209005 | A1 | 9/2006 | Pedram et al. | |
| 2008/0136844 | A1 * | 6/2008 | Takada et al. | 345/690 |
| 2009/0028460 | A1 * | 1/2009 | Jung et al. | 382/274 |
| 2010/0013871 | A1 | 1/2010 | Shen et al. | |

FOREIGN PATENT DOCUMENTS

KR 10-2009-0126337 A 12/2009

* cited by examiner

*Primary Examiner* — Chanh Nguyen
*Assistant Examiner* — Tsegaye Seyoum
(74) *Attorney, Agent, or Firm* — Sughrue Mion, PLLC

(57) ABSTRACT

Provided are a display apparatus and a method for controlling a backlight. A display apparatus including a backlight partitioned into a plurality of sections according to an exemplary embodiment of the present invention includes: an external brightness measurer measuring and providing front brightness values of the display apparatus corresponding to the sections; an image signal analyzer analyzing an inputted image signal and calculating and providing a brightness influence value of each section by adjacent sections; and a control signal corrector converting a source backlight control signal of each section corresponding to the image signal into an intermediate backlight control signal of each section on the basis of the front brightness values and the brightness influence values of the sections and comparing the intermediate backlight control signal with the previous final backlight control signal to generate the current final backlight control signal.

5 Claims, 4 Drawing Sheets

DISPLAY APPARATUS AND METHOD FOR CONTROLLING BACKLIGHT THAT CAN REDUCE IMAGE DISTORTION DUE TO LOCAL DIMMING

CROSS-REFERENCE TO RELATED APPLICATIONS

This application claims priority under 35 U.S.C. §119 to Korean Patent Application No. 10-2010-0081028, filed on Aug. 20, 2010, in the Korean Intellectual Property Office, the disclosure of which is incorporated herein by reference in its entirety.

TECHNICAL FIELD

The present invention relates to a display apparatus and a method for controlling a backlight, and more particularly, to a display apparatus and a method for controlling a backlight that can reduce image distortion generated due to local dimming by analyzing spatial and temporal brightness characteristics and using it and improve power efficiency by using a brightness perception characteristic.

BACKGROUND

Local dimming is a technology of portioning a backlight into a plurality of sections and controlling brightness values of the sections to be different from each other. For example, the local dimming is the technology that controls a backlight section of a part where a bright image is displayed to be bright and a backlight section of a part where a dark image is displayed to be dark in an image signal.

In the local dimming, since the brightness value varies for each section, the image may be distorted in the case where a difference in brightness among the sections is large. That is, the difference in brightness between the sections is large on a screen at a predetermined time, such that spatial distortion may occur. Further, depending on a difference in brightness between a previous frame and a current frame, spatial distortion may occur.

Further, the degree of user's perception of brightness variation depends on the circumferential brightness of the display apparatus or the backlight. In the case in which the local dimming is performed without considering it, power efficiency may be low.

SUMMARY

An exemplary embodiment of the present invention provides a display apparatus including a backlight partitioned into a plurality of sections, that includes: an external brightness measurer measuring and providing front brightness values of the display apparatus corresponding to the sections; an image signal analyzer analyzing an inputted image signal and calculating and providing a brightness influence value of each section by adjacent sections; and a control signal corrector converting a source backlight control signal of each section corresponding to the image signal into an intermediate backlight control signal of each section on the basis of the front brightness values and the brightness influence values of the sections and comparing the intermediate backlight control signal with the previous final backlight control signal to generate the current final backlight control signal.

Another exemplary embodiment of the present invention provides a method for controlling a backlight controlling the backlight partitioned into a plurality of sections in a display apparatus that includes: measuring front and rear brightness values of the display apparatus corresponding to the sections; analyzing an inputted image signal and calculating a brightness influence value of each section by adjacent sections; converting a source backlight control signal of each section corresponding to the image signal into an intermediate backlight control signal of each section on the basis of the front and rear brightness values and the brightness influence values of the sections; comparing the intermediate backlight control signal with the previous final backlight control signal to generate the current final backlight control signal; and controlling each section in accordance with the current final backlight control signal.

Other features and aspects will be apparent from the following detailed description, the drawings, and the claims.

DETAILED DESCRIPTION OF EMBODIMENTS

Figure 1:
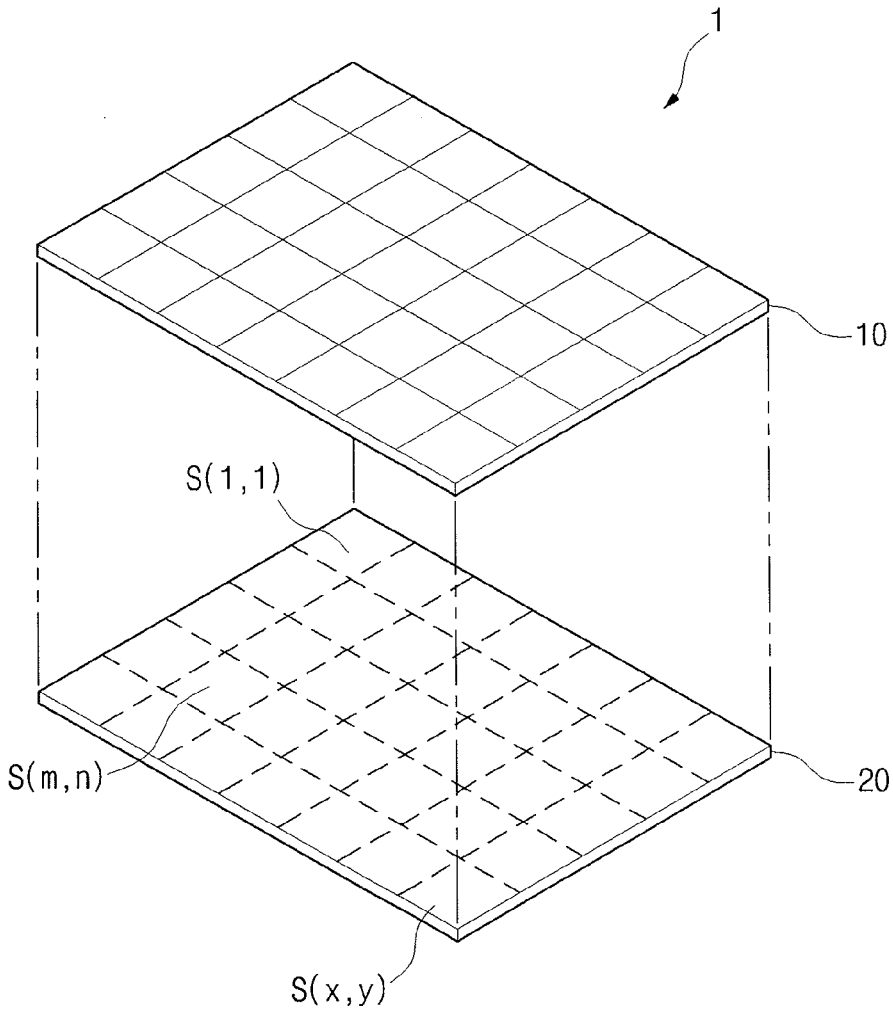
FIG. 1 is a conceptual diagram for describing a display apparatus according to an exemplary embodiment of the present invention.

Hereinafter, exemplary embodiments will be described in detail with reference to the accompanying drawings. Throughout the drawings and the detailed description, unless otherwise described, the same drawing reference numerals will be understood to refer to the same elements, features, and structures. The relative size and depiction of these elements may be exaggerated for clarity, illustration, and convenience. The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. Also, descriptions of well-known functions and constructions may be omitted for increased clarity and conciseness.

Figure 3:
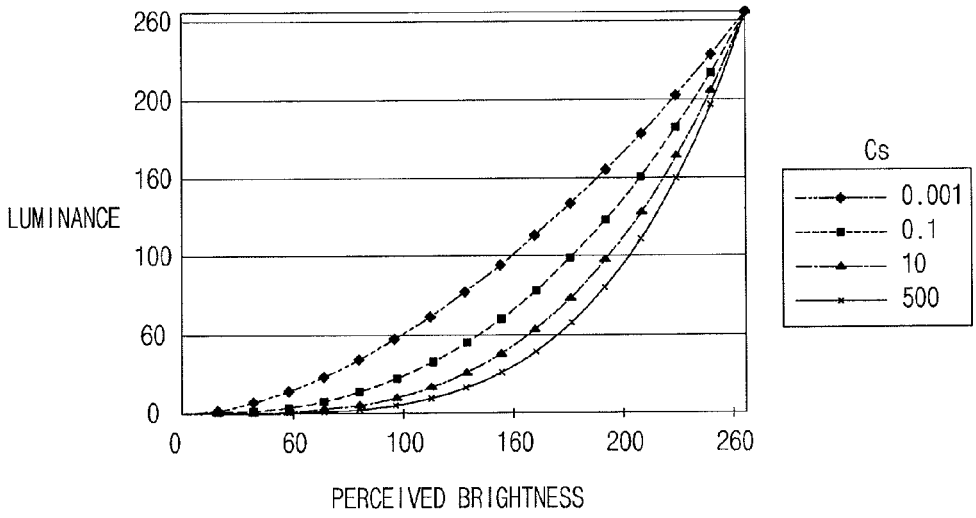
FIG. 3 shows graphs in which brightness variation perceived by the human depending on luminance is shown for each circumferential brightness.
Figure 4:
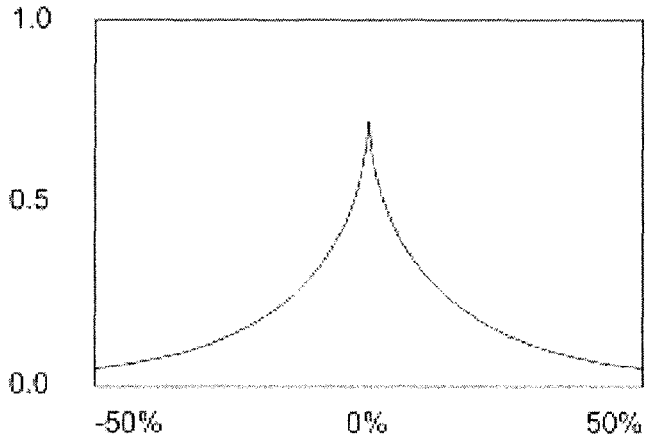
FIG. 4 is an exemplary graph for describing an operation for a control signal corrector to correct temporal distortion.

A display apparatus and a method for controlling a backlight according to an exemplary embodiments of the present invention will be described with reference to FIGS. 1 to 4. FIG. 1 is a conceptual diagram for describing a display apparatus according to an exemplary embodiment of the present invention, FIG. 2 is a block diagram for describing a display apparatus and a method for controlling a backlight according to an exemplary embodiment of the present invention, FIG. 3 shows graphs in which brightness variation perceived by the human depending on luminance is shown for each circumferential brightness, and FIG. 4 is an exemplary graph for describing an operation for a control signal corrector to correct temporal distortion.

First, referring to FIG. 1, the display apparatus 1 according to the exemplary embodiment of the present invention includes a display 10 and a backlight 20. The backlight 20 is divided into a plurality of sections S(1,1), S(m,n), and S(x,y). A brightness value may be controlled differently for each section. For example, when the display 10 is divided into a plurality of display regions to correspond to the sections of the backlight 20, the display apparatus 1 outputs a final backlight control signal by correcting a source backlight control signal generated depending on an image signal displayed in each display region in order to prevent spatial and temporal distortions, thereby controlling the brightness value differently for each section.

The display apparatus 1 will be described in more detail with reference to FIG. 2.

Figure 2:
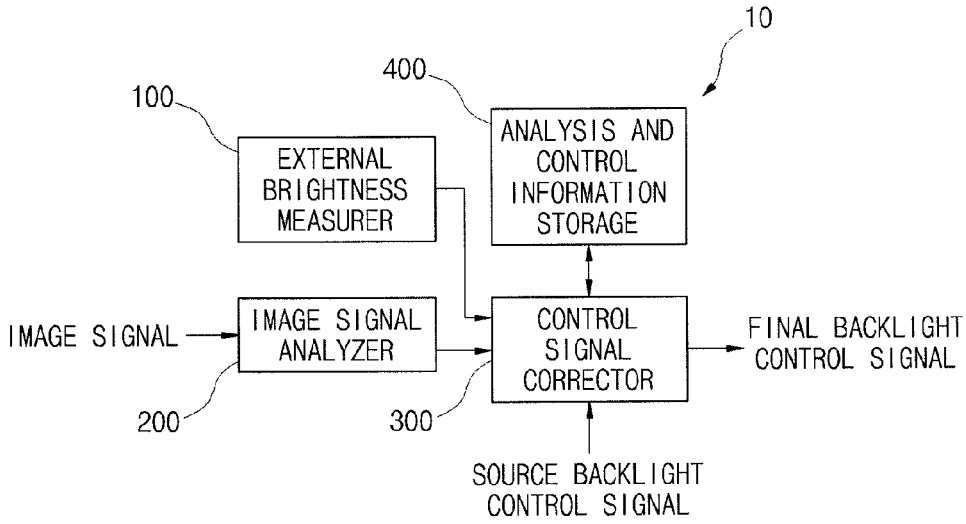
FIG. 2 is a block diagram for describing a display apparatus and a method for controlling a backlight according to an exemplary embodiment of the present invention.

Referring to FIG. 2, the display apparatus 1 according to the exemplary embodiment of the present invention includes an external brightness measurer 100, an image signal analyzer 200, a control signal corrector 300, and an analysis and control information storage 400.

The external brightness measurer 100 is mounted outside of the display apparatus 1 to measure the circumferential brightness of the display apparatus 1. That is, the external brightness measurer 100 measures the brightness of the circumference of the display apparatus 1 where a user views the display apparatus 1. Specifically, the external brightness measurer 100 may measure the front and/or the rear brightness of the display apparatus 1. For example, the external brightness measurer 100 measures a brightness value of the front of the display apparatus 1 corresponding to each of the sections S(1,1), S(m,n), and S(x,y) of the backlight to provide a front brightness value for each section. Alternatively, the external brightness measurer 100 measures a brightness value of the rear of the display apparatus 1 corresponding to each section to provide a rear brightness value for each section. Alternatively, the rear brightness value may be provided as not the brightness value for each section but one brightness value. The external brightness measurer 100 will be described below with reference to FIG. 5.

The image signal analyzer 200 receives an image signal transferred to the display 10 and analyzes the corresponding image signal to calculate a brightness influence value of each section by adjacent sections. For example, in FIG. 1, the image signal analyzer 200 calculates brightness influence values which the adjacent sections S(1,1) and S(x,y) give to the section S(m,n). The image signal analyzer 200 will be described below with reference to FIG. 6.

The control signal corrector 300 reduces the spatial distortion by correcting the source backlight control signal for each section on the basis of the front and/or rear brightness value(s) of the display apparatus 1 and the bright influence value of each section that are provided from the external brightness measurer 100 and the image signal analyzer 200.

Specifically, the control signal corrector 300 calculates a spatial circumferential brightness value Cs(m,n) of a section positioned at a coordinate (m,n) by using front and rear brightness values Sr(m,n) and Sf(m,n) transferred from the external brightness measurer 100 and a brightness influence value I(m,n) transferred from the image signal analyzer 200 with respect to the section S(m,n).

$$Cs(m,n)=Sr(m,n)+Sf(m,n)+I(m,n)$$

In addition, the control signal corrector 300 converts the source backlight control signal into an intermediate backlight control signal in accordance with the spatial circumferential brightness value Cs(m,n).

Referring back to FIG. 3, when the spatial circumferential brightness value Cs(m,n) is 0.001, 0.1, 10, and 500, graphs representing brightness perceived depending on luminance for each case are shown. A vertical axis of each graph represents the luminance of the backlight 10 or the display apparatus 1 and a horizontal axis of each graph represents brightness perceived depending on the luminance. Each unit of the graph is 0 to 265 (8 bits) gray.

In FIG. 3, when a case in which the spatial circumferential brightness value Cs(m,n) is 0.001 and a case in which the spatial circumferential brightness value Cs(m,n) is 500 are compared with each other, the variation of the brightness perceived by a user depending on the variation of the luminance is substantially linear in the case in which Cs(m,n) is 0.001, that is, the circumference is dark. That is, in the case in which the circumference is dark, when the luminance of the backlight or the display apparatus 1 varies, the user perceives that the variation is linear. However, in the case in which Cs(m,n) is 500, that is, the circumference is bright, when the luminance of the backlight or the display apparatus 1 is in the range of 0 to 60, that is, low, the user perceives the variation of the luminance very sensitively, but when the luminance of the backlight or the display apparatus 1 is in the range of 200 to 260, that is, high, the user does not well perceive the variation of the luminance. In other words, according to the user's brightness perception characteristic, at the location in which the circumference is bright, the user may perceive even small variation of the luminance when the luminance of the backlight or the display apparatus 1 is low and the user may perceive large variation of the luminance when the luminance of the backlight or the display apparatus 1 is high.

The control signal corrector 300 converts the source backlight control signal into the intermediate backlight control signal B'(m,n) to which the spatial circumferential brightness value Cs is reflected by using a predetermined function representing the degree of perception depending on the variation of the brightness of the backlight under predetermined circumferential brightness.

$$B'(m,n)=gs(Cs(m,n),V(m,n))V(m,n)$$

For specific example, in the case in which sections that are controlled by a source backlight control signal of 10 gray and a source backlight control signal of 60 gray, respectively exist, the user perceives the difference in luminance between both sections as a difference of approximately 50 gray at the location where the circumference is dark (see a graph in the case of Cs=0.001 in FIG. 3) and the user perceives a difference larger than the actual difference at the location where the circumference is bright (see a graph in the case of Cs=500 in FIG. 3). Therefore, the user perceives the spatial image distortion. Consequently, the control signal corrector 300 may output the source backlight control signal of 60 gray as the intermediate backlight control signal as it is at the location where the circumference is dark and output the source backlight control signal of 60 gray as, for example, the intermediate backlight control signal of 50 gray at the location where the circumference is bright. As a result, the spatial distortion is reduced and power is efficiently used.

Hereinafter, an operation of the control signal corrector 300 will be described. The control signal corrector 300 determines any one of functions shown in FIG. 3 by using the spatial circumferential brightness value Cs. If Cs is low, the control signal corrector 300 converts the source backlight control signal almost linearly. As described above, the reason is that the user perceives that the variation of the luminance is linear when the circumference is dark.

If Cs is high, the control signal corrector 300 converts the source backlight control signal so as to reduce the variation of the brightness depending on the variation of the source backlight control signal with respect to the source backlight control signal for controlling the brightness of each section to be equal to or less than reference brightness (i.e., 60 gray on a y axis of FIG. 3) by using the determined function. For example, the control signal corrector 300 may reduce the gray scale of the source backlight control signal and output it as the intermediate backlight control signal. As a result, power consumption may be reduced. Further, when the source backlight control signal is converted so as to reduce the variation of the brightness, the image distortion perceived by the user may be reduced.

Meanwhile, the control signal corrector 300 converts the source backlight control signal into the intermediate backlight control signal through the above operation to reduce the spatial distortion and generates the final backlight control signal from the intermediate backlight control signal through an operation to be described below to reduce the temporal distortion.

That is, since the temporal image distortion is generated even when the difference in brightness between the previous frame and the current frame is too large, the control signal corrector 300 compares the intermediate backlight control signal converted through the above process with the final backlight control signal of the previous frame and generates the final backlight control signal of the current frame within the range where the difference in brightness between the frames is too large. Hereinafter, it will be described in detail.

The control signal corrector 300 calculates the difference between brightness depending on the final backlight control signal $B(m,n)^{[t-1]}$ of the previous frame and brightness depending on the intermediate backlight control signal B'(m, n) for each section, scales the brightness difference depending on the spatial circumferential brightness influence Cs, and reflects the scaled brightness difference to the intermediate backlight control signal B'(m,n) to generate the final backlight control signal $B(m,n)^{[t]}$. Herein, the previous final backlight control signal $B(m,n)^{[t-1]}$ is provided from the analysis and control information storage 400 of FIG. 2.

Herein, the control signal corrector 300 first scales the difference between the brightness depending on the previous final backlight control signal $B(m,n)^{[t-1]}$ and the brightness depending on the intermediate backlight control signal B'(m, n) (hereinafter, referred to as first scaling) and thereafter, may additionally scale the brightness difference depending on the spatial circumferential brightness influence Cs (hereinafter, referred to as second scaling).

For example, in FIG. 4, a ratio of the first scaling depending on the difference $B'(m,n)-B(m,n)^{[t-1]}$ between the brightness depending on the previous final backlight control signal $B(m, n)^{[t-1]}$ and the brightness depending on the intermediate backlight control signal B'(m,n), which is performed by the control signal corrector 300 is shown. In the case in which the difference $B'(m,n)-B(m,n)^{[t-1]}$ between the brightness depending on the previous final backlight control signal $B(m, n)^{[t-1]}$ and the brightness depending on the intermediate backlight control signal B'(m,n) is almost 0, the control signal corrector 300 sets the ratio of the first scaling to 1. That is, the control signal corrector 300 immediately performs the second scaling of the brightness difference $B'(m,n)-B(m,n)^{[t-1]}$. However, when the brightness difference $B'(m,n)-B(m,n)^{[t-1]}$ is, the control signal corrector 300 sets the ratio of the first scaling to approximately ±50% to reduce the brightness difference $B'(m,n)-B(m,n)^{[t-1]}$ to approximately ±20%. In addition, the control signal corrector 300 performs the second scaling depending on the spatial circumferential brightness influence Cs.

Hereinafter, the second scaling will be described. The control signal corrector 300 determines any one of the functions shown in FIG. 3 by using the spatial circumferential brightness influence Cs. If Cs is low, the control signal corrector 300 converts the brightness difference $B'(m,n)-B(m,n)^{[t-1]}$ (the difference in the first scaled brightness in the case of the first scaling) almost linearly and adds it to the previous final backlight control signal $B(m,n)^{[t-1]}$ to output the current final backlight control signal.

If Cs is high, the control signal corrector 300 scales the brightness difference to reduce the brightness difference with respect to a signal for controlling the previous final backlight control signal $B(m,n)^{[t-1]}$ to be equal to or less than the reference brightness (i.e., 60 gray) by using the determined function and adds the scaled brightness difference to the previous final backlight control signal $B(m,n)^{[t-1]}$ to generate the current final backlight control signal. The control signal corrector 300 scales the brightness difference so as to increase the brightness difference with respect to a signal for controlling the previous final backlight control signal $B(m,n)^{[t-1]}$ to be larger than the reference brightness (i.e., 60 gray) and adds the scaled brightness difference to the previous final backlight control signal $B(m,n)^{[t-1]}$ to generate the current final backlight control signal.

As such, the control signal corrector 300 scales a brightness difference depending on the time in any one section by considering the spatial circumferential brightness influence Cs and adds the scaled brightness difference to the previous final backlight control signal to generate the current final backlight control signal. Accordingly, the temporal image distortion may be reduced and the power efficiency may be improved.

The current final backlight signal is stored in the analysis and control information storage 400.

Figure 5:
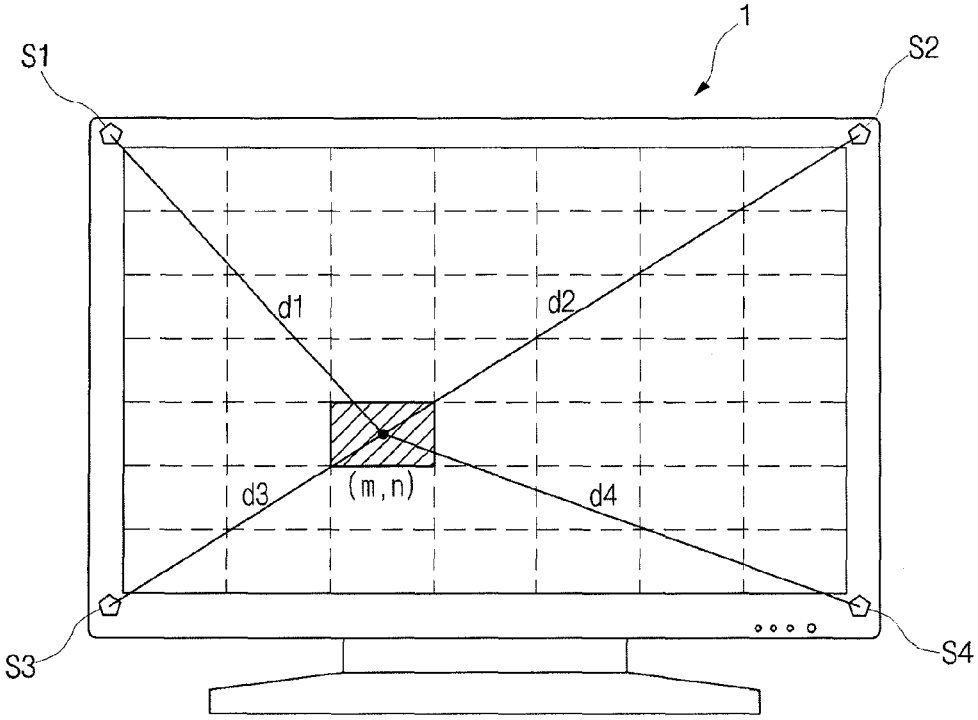
FIG. 5 is an exemplary diagram for describing an external brightness measurer of FIG. 2.

Hereinafter, the external brightness measurer 100 of FIG. 2 will be described in detail with reference to FIG. 5. FIG. 5 is an exemplary diagram for describing an external brightness measurer of FIG. 2.

The external brightness measurer 100 (shown in FIG. 2) may include one or more brightness sensors S1, S2, S3, and S4 that are mounted in front of the display apparatus 1 to measure brightness. The plurality of brightness sensors S1, S2, S3, and S4 measure the brightness for each section and may calculate the front brightness value of each section through information regarding distances d1, d3, d3, and d4 between the sensors S1, S2, S3, and S4 and the sections and interpolation. Further, the external brightness measurer 100 is mounted in the rear of the display apparatus 1 to measure a rear brightness value. In this case, the external brightness measurer 100 may calculate the rear brightness value in the same manner as the calculation of the front brightness value.

Figure 6:
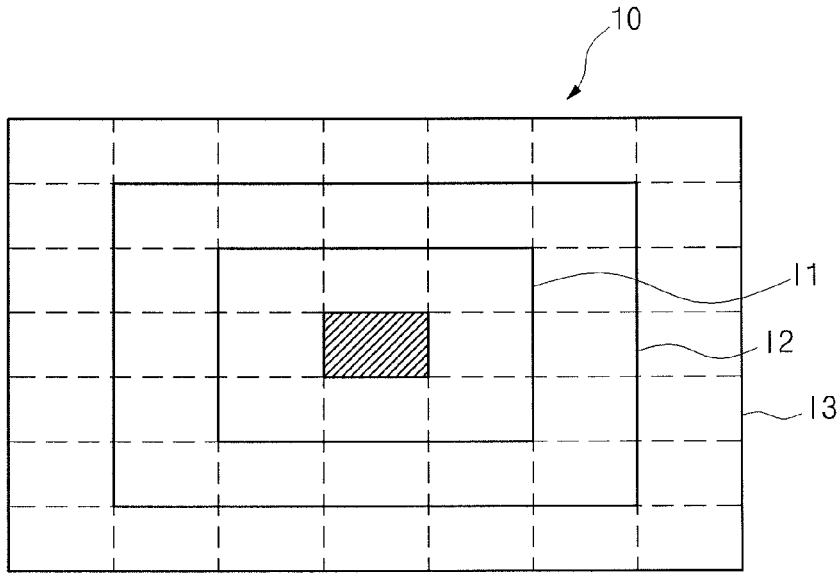
FIG. 6 is a conceptual diagram for describing an image signal analyzer of FIG. 2.

Next, the image signal analyzer of FIG. 2 will be described with reference to FIG. 6. FIG. 6 is a conceptual diagram for describing an image signal analyzer of FIG. 2.

Referring to FIG. 6, the image signal analyzer 200 (shown in FIG. 2) receives the image signal transferred to the display to calculate a brightness influence value of each section by the adjacent sections. For example, the image signal analyzer 200 partitions a region into a plurality of regions I1, I2, and I3 on the basis of a spatial distance from a predetermined section to calculate the mean brightness of each region. A gradual weight value given depending on the spatial distance from each section is added to the calculated mean brightness for each region to calculate a brightness influence value I(m,n) influencing the corresponding section and transfer the calculated brightness influence value I(m,n) to the controls signal corrector 300 (shown in FIG. 2). I(m,n) is calculated through the following equation by applying a weight value r for each region on the basis of k partitioned regions.

$$I_{(m,n)} = \sum_{k=1}^{k} r_k I_{(m,n)k}$$

Wherein the weight value r may be adjusted depending on the brightness perception difference which is dependent on the size and characteristic of the panel.

Meanwhile, the analysis and control information storage 400 (shown in FIG. 2), which stores the final backlight control signal generated by the control signal corrector 300, stores information for determining circumferential brightness corresponding to each section and the final backlight control signal and transfers the previous final backlight control signal to the control signal corrector 300 for temporal analysis in the control signal corrector 300.

According to the exemplary embodiments of the present invention, it is possible to reduce spatial distortion by controlling the brightness of each section of a backlight by using the change of an ability to perceive the variation of screen brightness depending on circumferential brightness. Further, it is possible to reduce even temporal distortion by considering the previous backlight control signal together with the circumferential brightness. Moreover, it is possible to reduce power consumption.

According to the exemplary embodiment of the present invention, the following effects can be acquired.

First, it is possible to reduce spatial and temporal distortions and improve power efficiency by optimizing brightness variation of a backlight to the degree of perception.

Second, a method for controlling the backlight according to the present invention can alleviate spatially and temporally perceived distortions and can be used to correct the distortion of various division backlight control applications.

Third, the method for controlling the backlight according to the present invention can be applied to both a light source scheme backlight such as an edge-lit type and a point light source scheme backlight in addition to a direct type backlight. Further, since a backlight control signal generated for local dimming is corrected according to the present invention, the method can be applied to all schemes even though the backlight control signal is generated in any scheme.

A number of exemplary embodiments have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A display apparatus including a backlight partitioned into a plurality of sections, comprising:

an external brightness measurer measuring and providing front brightness values of the display apparatus corresponding to the sections;

an image signal analyzer analyzing an inputted image signal and calculating and providing a brightness influence value of each section influenced by adjacent sections; and a control signal corrector converting a source backlight control signal of each section corresponding to the image signal into an intermediate backlight control signal of each section on the basis of the front brightness values and the brightness influence values of the sections and comparing the intermediate backlight control signal with a previous final backlight control signal to generate a current final backlight control signal, wherein the control signal corrector calculates a difference between brightness depending on the previous final backlight control signal and brightness depending on the intermediate backlight control signal for each section, scales the difference depending on a sum of each front brightness value and each brightness influence value, and adds the scaled difference to the previous final backlight control signal to generate the current final backlight control signal.

2. The apparatus of claim 1, wherein the external brightness measurer measures and provides rear brightness values of the display apparatus corresponding to the sections, and the control signal corrector converts the source backlight control signal of each section into the intermediate backlight control signal of each section on the basis of the front and rear brightness values and the brightness influence values.

3. The apparatus of claim 1, wherein when the sum of the front brightness value and the brightness influence value of each section is large rather than small, the control signal corrector converts the source backlight control signal for each section for controlling the brightness of each section to be equal to or less than reference brightness to reduce the variation in brightness of each section depending on the variation of the source backlight control signal, and converts the source backlight control signal for controlling the brightness of each section to be higher than the reference brightness to increase the variation in brightness of each section depending on the variation of the source backlight control signal.

4. A method for controlling a backlight controlling the backlight partitioned into a plurality of sections in a display apparatus, comprising:

measuring front and rear brightness values of the display apparatus corresponding to the sections;

analyzing an inputted image signal and calculating a brightness influence value of each section influenced by adjacent sections;

converting a source backlight control signal of each section corresponding to the image signal into an intermediate backlight control signal of each section on the basis of the front and rear brightness values and the brightness influence values of the sections;

comparing the intermediate backlight control signal with a previous final backlight control signal to generate a current final backlight control signal; and controlling each section in accordance with the current final backlight control signal, wherein the generating of the current final backlight control signal includes;

calculating a spatial circumferential brightness value of the display apparatus for each section on the basis of the front and rear brightness values and the brightness influence values; and calculating a difference between brightness depending on the previous final backlight control signal and brightness depending on the intermediate backlight control signal for each section;

scaling the difference for each section depending on the calculated spatial circumferential brightness value of the section by using a predetermined function representing the degree of perception depending on the variation of the brightness of the backlight under predetermined circumferential brightness; and adding the scaled difference to the previous final backlight control signal to generate the current final backlight control signal.

5. The method of claim 4, wherein the converting into the intermediate backlight control signal includes:

calculating a spatial circumferential brightness value of the display apparatus for each section on the basis of the front and rear brightness values and the brightness influence values; and converting the source backlight control signal of the section into the intermediate backlight control signal of each section depending on the calculated spatial circumferential brightness value of the section by using a predetermined function representing the degree of perception depending on the variation of the brightness of the backlight under predetermined circumferential brightness.

* * * * *